US008948645B2

(12) United States Patent
Nakatsu

(10) Patent No.: US 8,948,645 B2
(45) Date of Patent: Feb. 3, 2015

(54) OPTICAL SCANNING APPARATUS

(75) Inventor: Haruhiko Nakatsu, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 74 days.

(21) Appl. No.: 13/243,212

(22) Filed: Sep. 23, 2011

(65) Prior Publication Data

US 2012/0082483 A1 Apr. 5, 2012

(30) Foreign Application Priority Data

Oct. 5, 2010 (JP) ..... 2010-225879

(51) Int. Cl.
*G03G 21/00* (2006.01)
*G03G 21/16* (2006.01)

(52) U.S. Cl.
CPC ..... *G03G 21/1666* (2013.01)
USPC ..... 399/98

(58) Field of Classification Search
USPC ..... 399/98, 118
See application file for complete search history.

(56) References Cited

U.S. PATENT DOCUMENTS 7,203,444 B2 * 4/2007 Yamazaki ..... 399/98

FOREIGN PATENT DOCUMENTS

| | | | |
|---|---|---|---|
| JP | S61-149916 | A | 7/1986 |
| JP | U 01-155066 | | 10/1989 |
| JP | 5-80268 | A | 4/1993 |
| JP | 2001-091887 | A | 4/2001 |
| JP | 2002-127495 | A | 5/2002 |
| JP | 2003-307695 | A | 10/2003 |
| JP | 2005-156773 | A | 6/2005 |
| JP | 2008-185691 | A | 8/2008 |

* cited by examiner

*Primary Examiner* — Hoang Ngo
(74) *Attorney, Agent, or Firm* — Canon USA, Inc., I.P. Division

(57) ABSTRACT

An optical scanning apparatus including a deflection unit configured to deflect a light beam emitted from a light source so that the light beam scans on a photosensitive member, a casing which is configured to house the light source and the deflection unit inside the casing and which is provided with an aperture that transmits the light beam deflected by the deflection unit out from the casing, a first light transmission member provided on the aperture for dust-proofing an interior of the casing, which is configured to transmit the light beam incident on the aperture, and a support member configured to support a second light transmission member for transmitting a light beam that has been transmitted through the first light transmission member and dust-proofing the first light transmission member, wherein the second light transmission member is detachable from the support member.

5 Claims, 12 Drawing Sheets

OPTICAL SCANNING APPARATUS

BACKGROUND OF THE INVENTION

1. Field of the Invention

One of the aspects of the present invention relates to an optical scanning apparatus included in an electrophotographic image forming apparatus, and more particularly to a dust-proof mechanism in an optical scanning apparatus.

2. Description of the Related Art

Electrophotographic image forming apparatuses, such as laser beam printers and digital copying machines, include an optical scanning apparatus. The casing of the optical scanning apparatus houses optical elements such as a rotating polygonal mirror, a reflection mirror, and a transmission lens. An optical element becomes dirty due to dust adherence to the optical element, resulting in deterioration of performance of the optical element. For example, for a mirror, the ratio of reflected light amount to incident light amount decreases, while for a lens, the ratio of transmitted light amount to incident light amount decreases. Therefore, to prevent the optical elements from becoming dirty from dust that infiltrates from outside the casing, a transparent member, such as a dust-proof glass, can be arranged on an aperture portion through which scanning light passes.

For example, Japanese Patent Application Laid-Open No. 5-80268 discusses an optical scanning apparatus in which a transparent member is adhesively fixed to an aperture portion of the casing, and laser light is emitted from the transparent member.

One way of cleaning the dirt adhering to the transparent member is to remove the transparent member from the optical scanning apparatus and clean or replace the transparent member. However, removing the transparent member means that the interior of the casing is temporarily open to the outside. Consequently, dust enters into the casing when the transparent member is removed.

SUMMARY OF THE INVENTION

One of the aspects of the present invention is directed to an optical scanning apparatus in which the entry of dust into a casing during cleaning or replacement of a transparent member is suppressed.

According to an aspect of the present invention, an optical scanning apparatus includes a deflection unit configured to deflect a light beam emitted from a light source so that the light beam scans on a photosensitive member, a casing which is configured to house the light source and the deflection unit therein and which is provided with an aperture that transmits the light beam deflected by the deflection unit out from the casing, a first light transmission member provided on the aperture for dust-proofing an interior of the casing, which is configured to transmit the light beam, and a support member configured to support a second light transmission member for transmitting a light beam that has been transmitted through the first light transmission member and dust-proofing the first light transmission member, wherein the second light transmission member is detachable from the support member.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
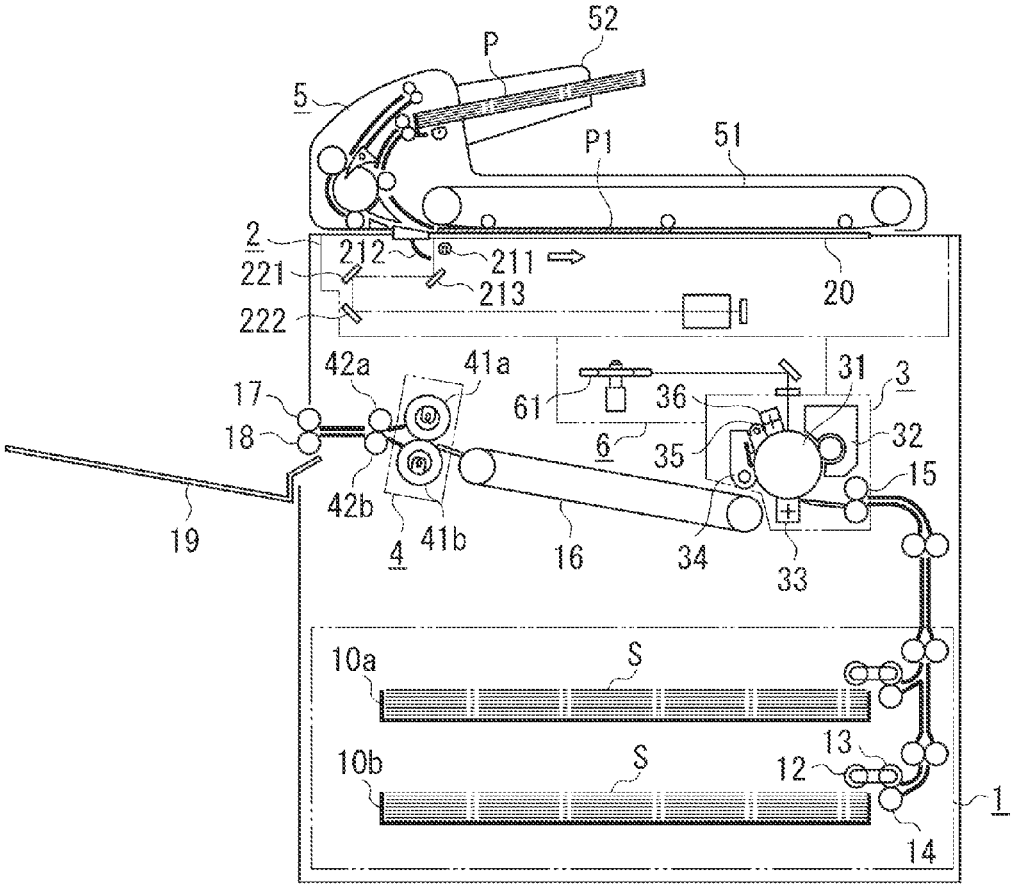
FIG. 1 is a cross-sectional view of an image forming apparatus according to a first exemplary embodiment.

A first exemplary embodiment will now be described. FIG. 1 is a cross-sectional schematic view of a digital copying machine (image forming apparatus) illustrating an exemplary embodiment. A document P1 set on a document positioning glass plate is read by a reading optical system 2, and is converted into an image signal. The image signal is acquired by a (not illustrated) digital processing unit and converted into digital data. Then, the digital data is converted into image data by performing the required data processing, and the image data is output to a (not illustrated) video conversion unit. The image data is converted by the video conversion unit into a video signal, and an optical scanning apparatus 6 outputs a light beam based on this video signal.

The optical scanning apparatus 6 includes a deflection apparatus 61, which is a deflection unit, a (not illustrated) light source apparatus and an optical element. The optical scanning apparatus 6 outputs the light beam for forming the image based on a signal from the (not illustrated) video conversion unit. The output light beam is irradiated on a photosensitive drum 31, which is a photosensitive member, and forms a latent image. The photosensitive drum 31 rotates, and in a developing unit 32, toner adheres to the latent image portion and the latent image is developed.

A transfer material S in a sheet cassette 10*a* or 10*b* is fed into the machine one sheet at a time by a feed roller 12, and conveyed to the photosensitive drum 31 via a registration roller 15. A developed image on the photosensitive drum 31 is transferred onto the conveyed transfer material S by a transfer charging device 33. Then, the transfer material S is conveyed by conveyance unit 16, and reaches a fixing device 4. At the fixing device 4, the image transferred onto the transfer material is fixed. Then, the transfer material S is discharged to a sheet discharge tray 19 via sheet discharge rollers 17 and 18. The next transfer material is similarly conveyed after a predetermined interval from the transfer material S, subjected to the image forming process, and discharged to the sheet discharge tray 19.

Next, toner remaining on the photosensitive drum 31 is removed by a cleaner 34. The photosensitive drum 31 is neutralized by a neutralization device 35, charged by a charging device 36, and then a latent image is again formed on the photosensitive drum 31 by the optical scanning apparatus 6.

In such an image process, the optical scanning apparatus 6 of the digital copying machine according to the present exemplary embodiment has the following configuration.

Figure 2:
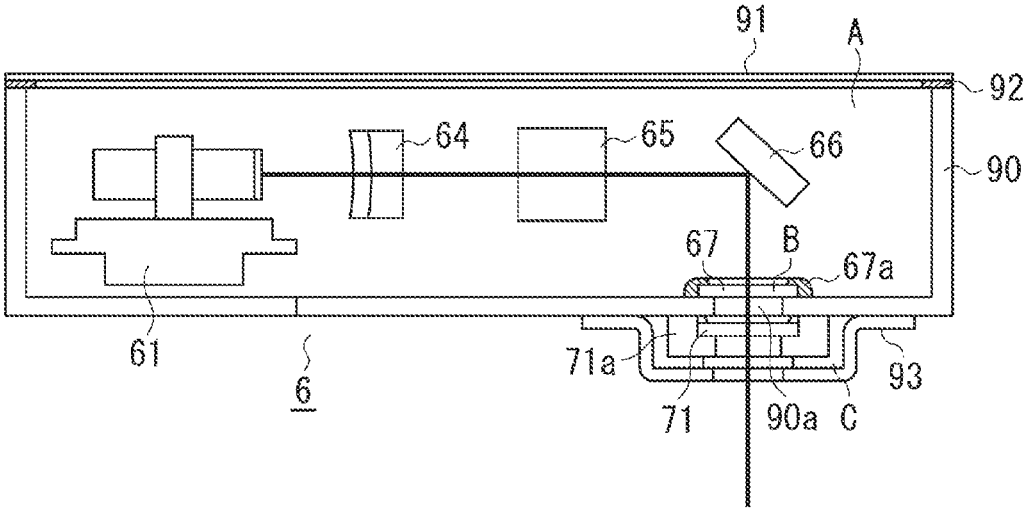
FIG. 2 is a schematic cross-sectional view of an optical scanning apparatus according to the first exemplary embodiment.
Figure 3:
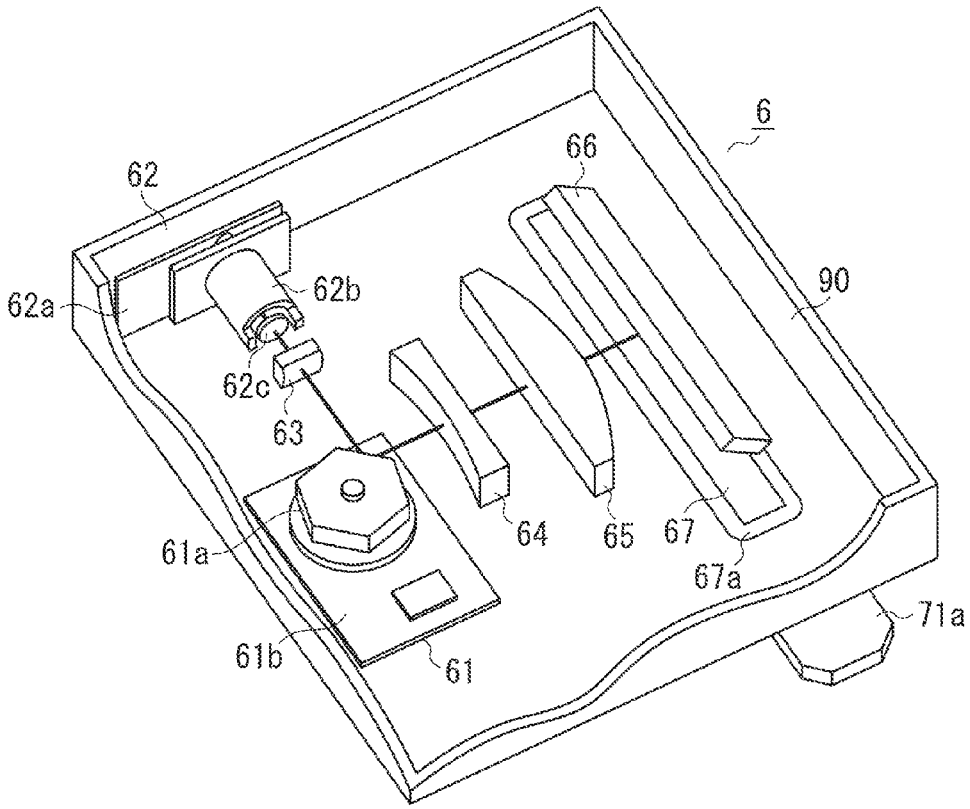
FIG. 3 is a schematic perspective view of an optical scanning apparatus according to the first exemplary embodiment.

FIG. 2 is a schematic plan view of the optical scanning apparatus 6, and FIG. 3 is a schematic perspective view of the optical scanning apparatus 6. Alight source unit 62 has a (not illustrated) semiconductor laser, a drive electrical board 62*a* for the semiconductor laser, a collimator lens barrel 62*b*, a collimator lens 62*c*, and a (not illustrated) aperture diaphragm. The cylinder lens 63 in FIG. 3 has a refractive power in the vertical direction of the paper sheet in FIG. 2. The deflection apparatus 61 is a deflection unit that deflects the laser light emitted from the semiconductor laser so that the laser light scans the photosensitive drum 31 in a predetermined direction (a direction roughly parallel to the rotational axis of the photosensitive drum 31). The deflection unit includes a polygonal mirror 61*a*, which is a rotating polygon mirror, and a drive board 61*b*. The polygonal mirror 61*a* is driven by a (not illustrated) drive motor mounted on the drive board 61*b*. A motor drive circuit is mounted on the drive board 61*b*. A toric lens 64, which is an optical element, and a cylinder lens 65 configure one of the main elements in the scanning optical system. The toric lens 64 and the cylinder lens 65 are provided to form an image from the laser light on the photosensitive drum 31 at a predetermined spot diameter. A reflection mirror 66, which is an optical element, reflects laser light that has passed through the cylinder lens 65 toward a below-described aperture portion 90*a* (an opening portion). If these optical elements become dirty with dust, the quality of the output image deteriorates. Therefore, these elements need to be dust proofed. Consequently, the above optical elements are arranged in an optical housing (inside a casing). Each of the above-described optical elements is supported in an optical housing 90 by (not illustrated) positioning and fixing members.

The aperture portion 90*a* is formed on the optical housing 90. The aperture portion 90*a* transmits laser light (scanning light) that has been deflected by the polygonal mirror 61*a*. A fixed dust-proof window 67, which is a first light transmission member, is attached to the aperture portion 90*a*. The fixed dust-proof window 67 is formed from a parallel plate glass transparent member with a thickness of about 2 mm. The fixed dust-proof window 67 is larger in both the width direction and the depth direction than the aperture portion 90*a*. The fixed dust-proof window 67 is arranged on an inner side of the optical housing 90 so as to cover the aperture portion 90*a*. The periphery of fixed dust-proof window 67 is fixed by an ultraviolet curing adhesive 67*a*. After fixing with the adhesive, there is no gap between the fixed dust-proof window 67 and the optical housing 90, so that the airtightness is very high.

After the above optical elements have been housed in the optical housing 90, the upper face is closed with a top cover 91 (lid). The top cover 91 is fixed to the optical housing 90 by a screw, without using an adhesive, so that the top cover 91 can be removed. A rubber sheet 92, for example, is sandwiched between the optical housing 90 and the top cover 91. Since the rubber sheet 92 seals gaps, by attaching the top cover 91, the inside of the optical housing 90 is sealed. In the present exemplary embodiment, the optical housing 90 and the top cover 91 together form the casing, and the aperture portion 90*a* is provided on the casing. The aperture portion 90*a* may be provided on the optical housing 90 or on the top cover 91.

A first space (space A in FIG. 2) is formed by the space between the optical housing 90, the fixed dust-proof window 67, and the top cover 91. Although the semiconductor laser, the drive circuit motor, and the motor drive circuit generate heat in the first space which has improved airtightness, the fact that the size of the first space is large as compared to the amount of generated heat, and the fact that the warmed air is stirred by the rotation of the polygonal mirror 61*a* in the optical housing 90 mean that there is no localized increases in temperature. Consequently, the temperature is only about 5° C. hotter than outside the first space.

The method for fixing the fixed dust-proof window 67 and the optical housing 90 with a high level of airtightness is not limited to a ultra violet curing adhesive. Anaerobic adhesives that cure at ordinary temperatures, silicon resin adhesives, or epoxy resin adhesives may also be used.

The effects on the image of dust that has entered inside of the optical scanning apparatus will now be described.

When closely looked at, the sealing properties of an optical scanning apparatus are not sufficient. Consequently, a minute amount of dust enters the inside of the optical scanning apparatus. The dust in the optical scanning apparatus flies around due to air currents produced in the optical scanning apparatus from the rotation of the polygonal mirror 61*a*, and the increases and decreases in pressure caused by the repeated rise and fall of the temperature in the optical scanning apparatus when repeatedly starting and stopping the apparatus. The dust that is flying around adheres to irregular locations on the reflection mirror and the lenses. When dust adheres to the reflection mirror or the lenses it blocks the light beam from hitting these parts, so that density change portions in a streak shape are produced in an image.

Further, the dust also tends to adhere to the upstream rotation side of the respective reflection faces of the rotating polygonal mirror 61*a* due to Karman vortex produced during rotation, which causes density changes to occur on the image write side and in the overall image. If the amount of adhering dust varies for each reflection face of the polygonal mirror 61*a*, pitch unevenness is produced in the scanning lines. Consequently, image deterioration, such as density changes in the image, occurs.

When the sealing properties of the optical housing 90 are sufficient, air cannot enter or exit the casing. Consequently, dust does not adhere to optical elements. However, for an apparatus that forms images using toner, which is made of fine particles, the outer side of the transparent member becomes dirty from the toner.

To reduce the effects on the image of the toner adhering to the transparent member, it is necessary to periodically clean or replace the transparent member. For an optical scanning apparatus in which the transparent member is fixed to the casing, it is difficult to see the transparent glass when the optical scanning apparatus is mounted on the image forming apparatus. Therefore, it is difficult to clean the transparent member when the optical scanning apparatus is mounted on the image forming apparatus. Either the optical scanning apparatus has to be temporarily removed from the image forming apparatus when cleaning the transparent member, or the dust adhering to the surface of the transparent member has to be wiped off with a cleaning member attached to a rod-like tip without being viewed directory. Further, this operation takes time and effort.

If the transparent member arranged in the optical housing 90 can be detachable to facilitate cleaning, when the dust-proof glass is removed, the dust, which is in contact with the warm air in the optical element housing space, tends to touch the optical elements due to the increase in Brownian motion activity of the dust. Further, when the aperture portion 90*a* is provided on a side face portion, dust from outside the optical housing 90 is sucked in along with the air due to convection, and adheres to the reflection mirror and lenses.

Therefore, the optical scanning apparatus according to the present exemplary embodiment is characterized in that two transparent members are arranged near the aperture portion which transmits the laser light, with one of the dust-proof glass part being detachable. More specifically, the laser light is transmitted through the first transparent member, then through a second transparent member, which is a second light transmission member, and reaches the photosensitive drum 31. Further, the second transparent member is detachable from the casing.

Figure 4:
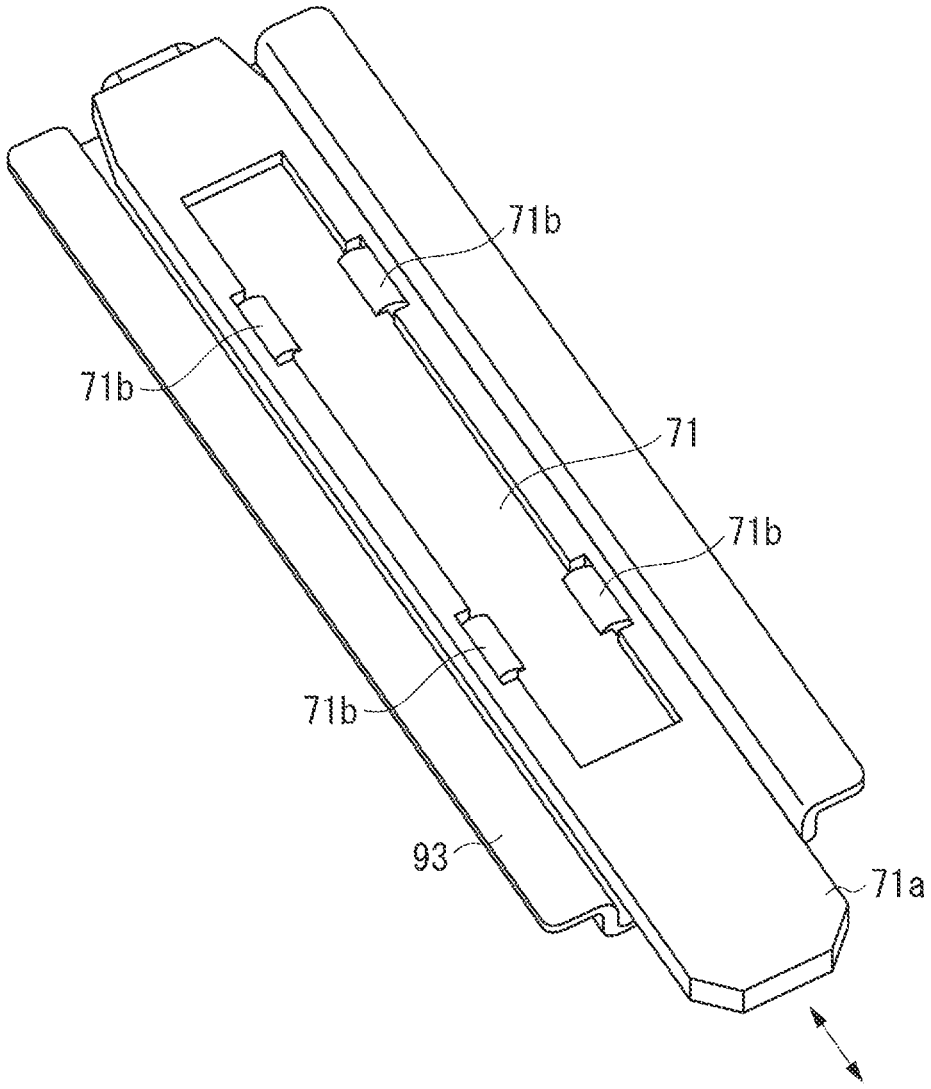
FIG. 4 illustrates a movable dust-proof window and surrounding members according to the first exemplary embodiment.

A movable dust-proof window 71, which is the second transparent member, will now be described in more detail referring to FIGS. 2 and 4. FIG. 4 illustrates only the movable dust-proof window 71 and its surrounding parts from the same direction as FIG. 3.

The movable dust-proof window 71 is formed from a parallel plate glass with a thickness of about 2 mm. The movable dust-proof window 71 is mounted on a dust-proof window holding member 71*a*. A part of the glass periphery is fixed by an adhesive 71*b*. Similar to the fixed dust-proof window 67, although the fixing method uses a ultra violet curing resin, an anaerobic adhesive, a silicon resin adhesive, or an epoxy resin adhesive may be used.

A guide member 93, which is an attachment member provided on the optical housing 90, is fixed to the aperture portion 90*a* periphery of the optical housing 90. The movable dust-proof window 71 is inserted so that it can slide in the arrow direction along the guide member 93 with the dust-proof window holding member 71*a*. More specifically, the guide member 93 functions as a support member for supporting the movable dust-proof window 71 and the dust-proof window holding member 71*a* when these parts are attached to the guide member 93. The guide member 93 limits the movement direction of the movable dust-proof window 71 to the direction that the laser light scans the photosensitive member when attaching the movable dust-proof window 71. Consequently, the movable dust-proof window 71 can be easily removed even without visually seeing the aperture portion 90*a* vicinity.

Similar to the optical housing 90, an aperture for transmitting scanning light is provided on the dust-proof window holding member 71*a* and the guide member 93. Further, the dust-proof window holding member 71*a* is pressed onto the optical housing 90 by a (not illustrated) urging member provided on the guide member 93.

When the movable dust-proof window 71 is inserted in the guide member 93, a second space (space B in FIG. 2) is formed from the optical housing 90, the fixed dust-proof window 67, the dust-proof window holding member 71*a*, and the movable dust-proof window 71. In addition, the space C in FIG. 2 will be referred to as a third space. When the movable dust-proof window 71 is attached, the second space becomes sealed. Consequently, it is difficult for dust in the image forming apparatus to adhere to the fixed dust-proof window 67. On the other hand, when the movable dust-proof window 71 is removed to clean the dust adhering to the movable dust-proof window 71 or to replace the movable dust-proof window 71, the airtight state of the optical housing 90 is secured, so that dust does not enter the optical housing 90.

A cleaning member for wiping the fixed dust-proof window 67 when removing or attaching to/from the guide member may be provided on the movable dust-proof window 71. Consequently, dust that adheres to the fixed dust-proof window 67 when cleaning the movable dust-proof window 71 can be removed.

Figure 5:
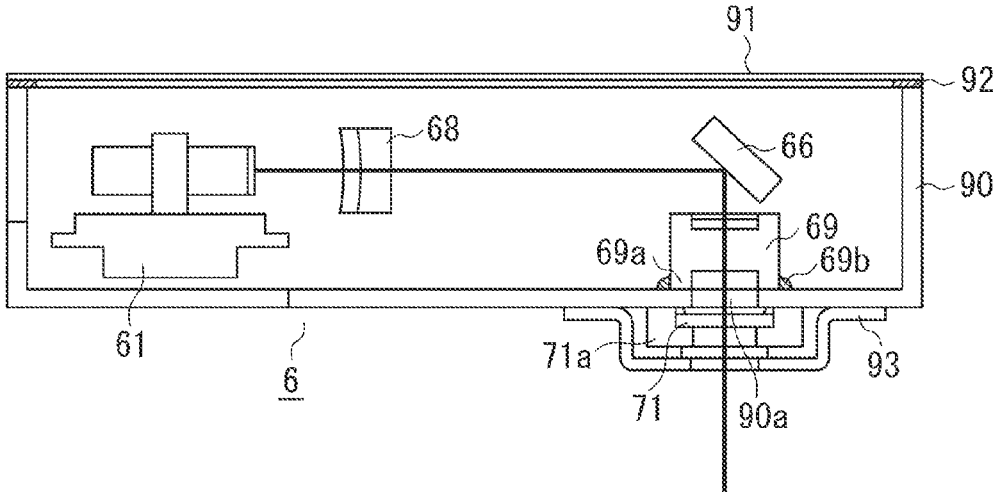
FIG. 5 is a schematic cross-sectional view of an optical scanning apparatus according to a second exemplary embodiment.
Figure 6:
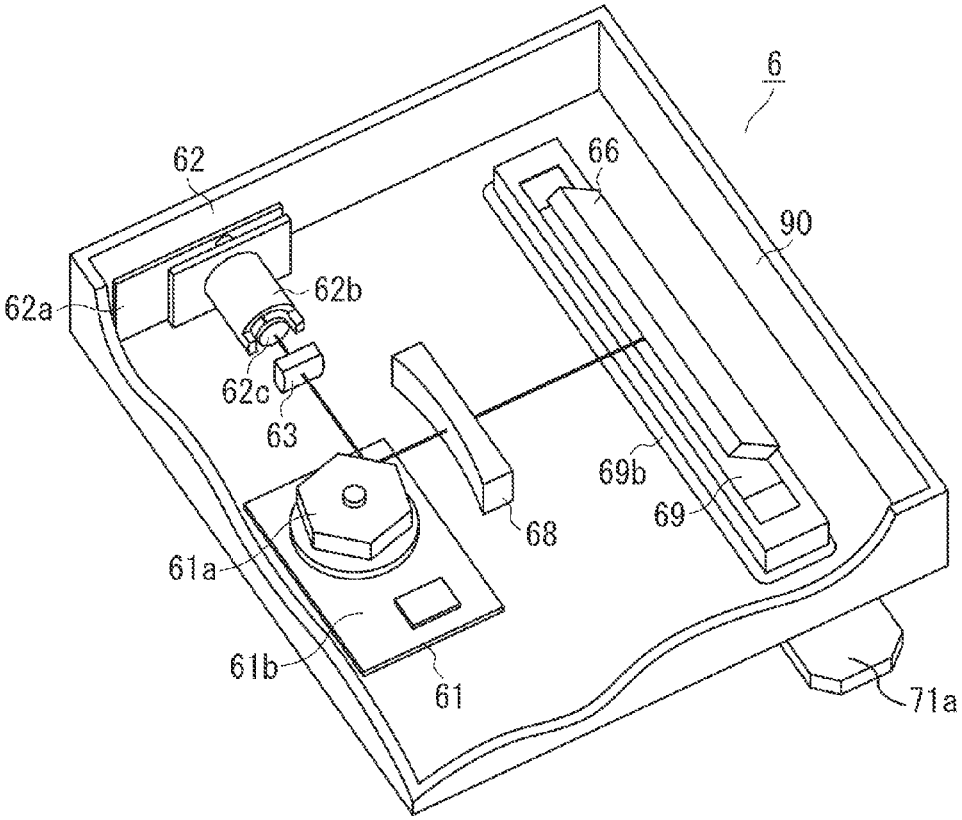
FIG. 6 is a schematic perspective view of an optical scanning apparatus according to the second exemplary embodiment.

A second exemplary embodiment will now be described. FIG. 5 is a schematic plan view of the optical scanning apparatus 6, and FIG. 6 is a schematic perspective view of the optical scanning apparatus 6. Parts having the same function as in FIGS. 2 and 3 are denoted with the same reference numerals, and a description thereof will be omitted here.

A toric lens 68 and a diffractive optical element 69 are optical elements for forming laser light into an image on the photosensitive drum 31 at a predetermined spot diameter. The aperture portion 90*a* which transmits laser light (scanning light) deflected by the polygonal mirror 61*a* is formed on the optical housing 90. A flange member 69*a* for mounting the diffractive optical element 69 on the aperture portion 90*a* of the optical housing 90 is provided on the optical housing 90. The flange member 69*a* is formed having an inner periphery that is equal to or larger than the aperture portion 90*a* in both the width direction and the depth direction.

The diffractive optical element 69 is arranged on the inner side of the optical housing 90 so as to cover the aperture portion 90*a*. The diffractive optical element 69 is attached to the optical housing 90 by a (not illustrated) positioning member provided on the mounting face or on another portion. The outer periphery of the diffractive optical element 69 is fixed by a ultra violet curing adhesive 69*b*. After fixing with the adhesive, there is no gap between the diffractive optical element 69 and the optical housing 90, so that the airtightness is very high.

Figure 7:
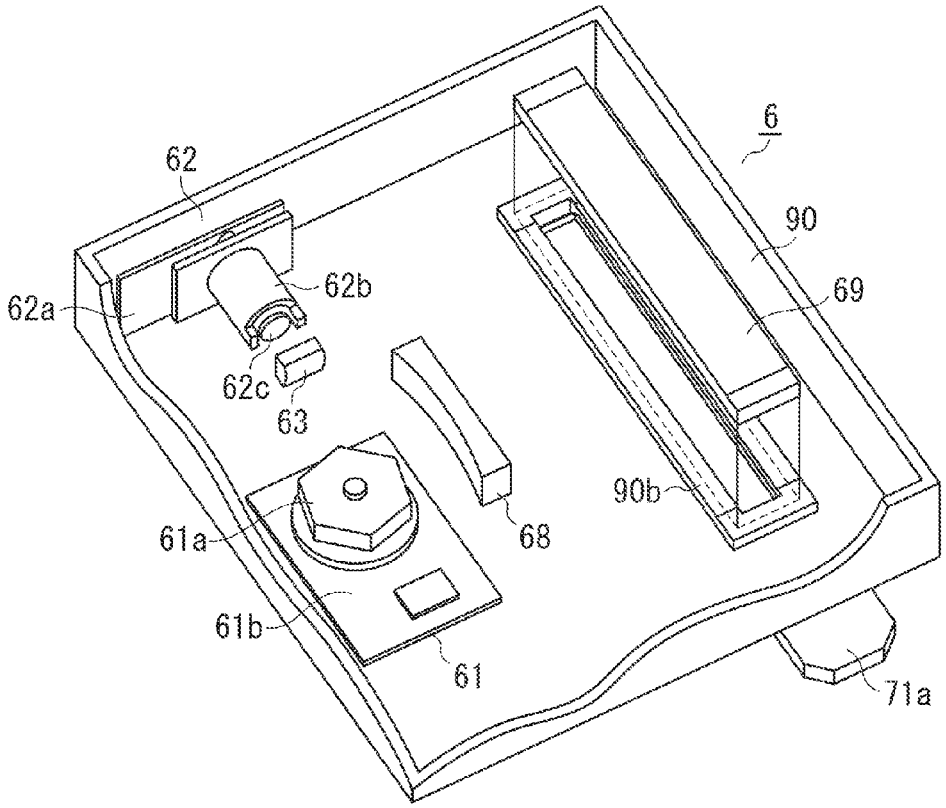
FIG. 7 is a schematic perspective view illustrating another example of an optical scanning apparatus according to the second exemplary embodiment.
Figure 8:
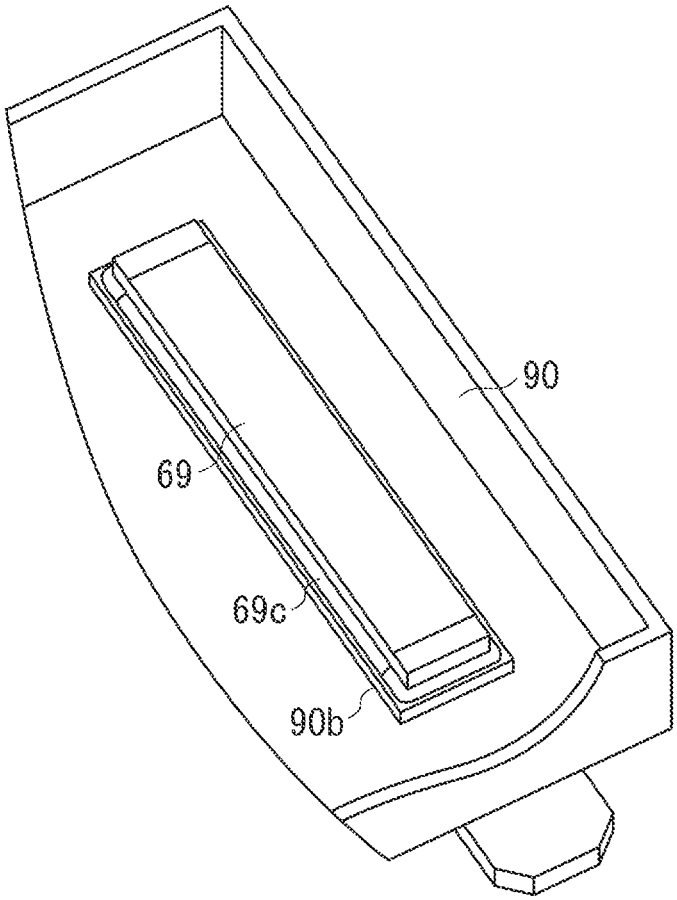
FIG. 8 is an enlarged view of near the aperture portion in another example of an optical scanning apparatus according to the second exemplary embodiment.

FIG. 7 illustrates a different method for mounting the diffractive optical element 69. FIG. 7 differs from FIG. 6 in that the reflection mirror 66 is not illustrated, and in that the diffractive optical element 69 is positioned away from a predetermined position. FIG. 8 illustrates a state in which the diffractive optical element 69 is mounted at a predetermined position.

The periphery of the aperture portion 90*a* on the optical housing 90 has a flange member 90*b* for mounting the diffractive optical element 69. The inner periphery of the flange member 90*b* is formed smaller than the external form of the diffractive optical element 69 in both the width direction and the depth direction. Further, the outer periphery of the flange member 90*b* is formed larger than the external form of the diffractive optical element 69 in both the width direction and the depth direction. The mounting face of the diffractive optical element 69 is formed so as to follow the curved surface of the diffractive optical element 69. The diffractive optical element 69 is mounted on the flange member 90*b*, and its outer periphery is fixed by a ultra violet curing adhesive 69*c*.

The diffractive optical element 69 may be provided at a position that corresponds to at least either the first transparent member or the second transparent member according to the first exemplary embodiment.

Figure 9:
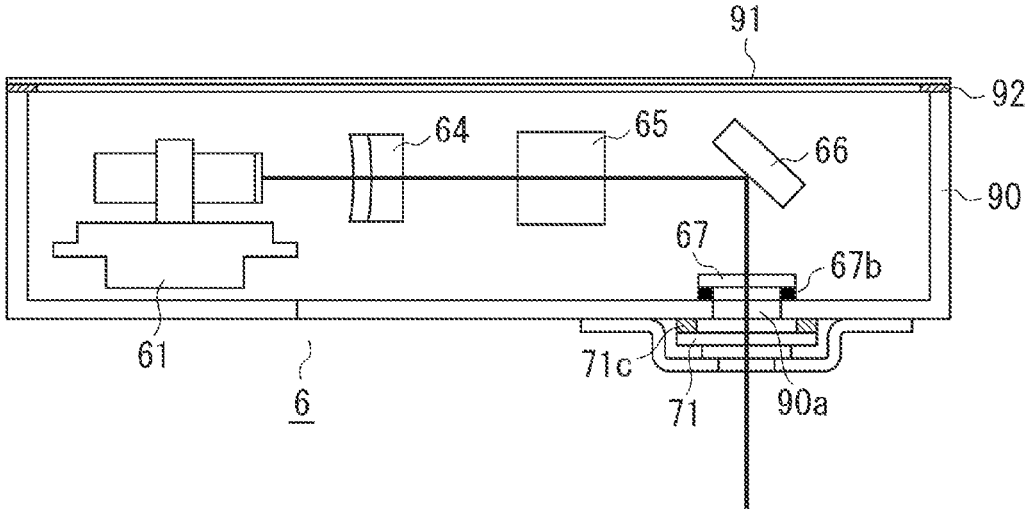
FIG. 9 is a schematic cross-sectional view of an optical scanning apparatus according to a third exemplary embodiment.

A third exemplary embodiment will now be described. FIG. 9 is a schematic plan view of the optical scanning apparatus 6. Parts having the same function as in FIG. 2 are denoted with the same reference numerals, and a description thereof will be omitted here.

How the parts are housed, the cover etc., the configuration, and the first space will now be described. The aperture portion 90*a* through which laser light deflected by the polygonal mirror 61*a* is transmitted is formed on the optical housing 90. On the side on which the fixed dust-proof window 67 of the aperture portion 90*a* is arranged, a seal material A 67*b* is adhesively fixed by double-faced tape, for example, to the periphery of the aperture portion 90*a*. The face on the opposite side to the optical housing adhering face side is adhesively fixed by double-faced tape, for example, to the fixed dust-proof window 67.

A rubber sheet having a thickness of 1 to 2 mm is used for the seal material A. However, the present invention is not limited to this. For example, a seal material obtained by foam molding of a synthetic rubber having a high airtightness performance, or a material obtained by foam molding of polyurethane or polyethylene may be used. Especially, among foam molding materials, a closed-cell foam in which the air bubbles are not connected to each other is used.

Figure 10:
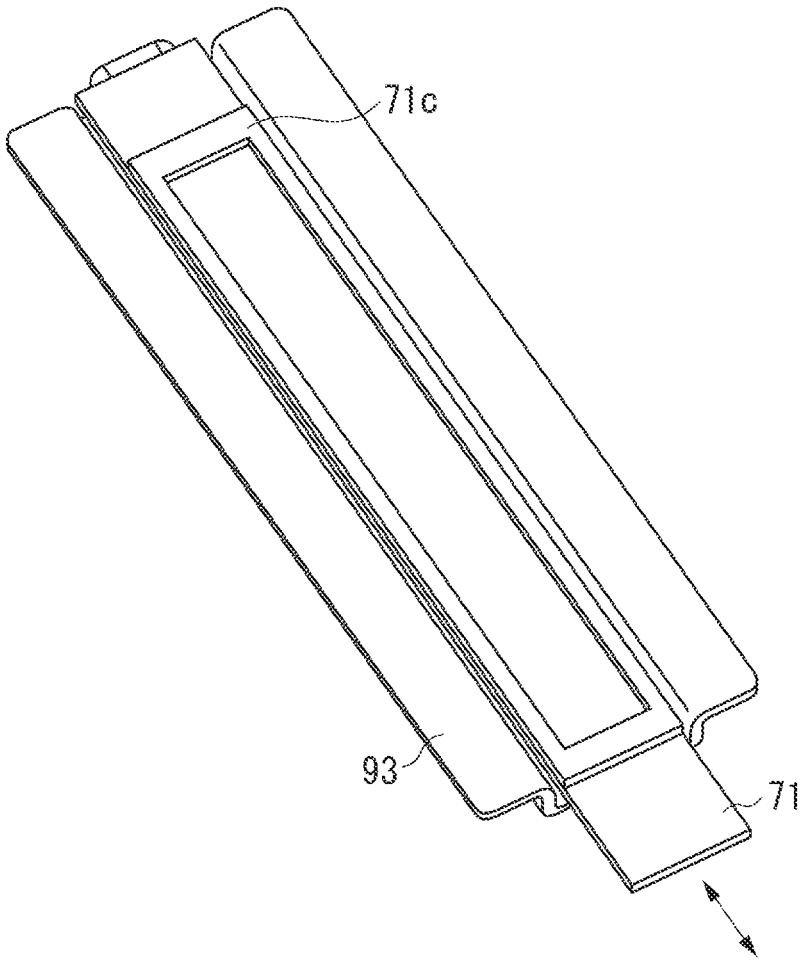
FIG. 10 illustrates a movable dust-proof window and surrounding members according to the third exemplary embodiment.

Next, the movable dust-proof window 71 will be described referring to FIGS. 9 and 10. FIG. 10 illustrates only the movable dust-proof window and the surrounding members from the same direction as FIG. 3. When the movable dust-proof window 71 is mounted on the optical scanning apparatus 6, except for where the scanning light is transmitted, a seal material B 71*c* is adhesively fixed by double-faced tape, for example, to one side of the movable dust-proof window 71.

A foam molding material is used for the seal material B. Among such materials, an open-cell foam in which the air bubbles are connected to each other formed by foam molding of polyurethane or polyethylene is used.

The guide member 93 is fixed to the aperture portion periphery of the optical housing 90. The movable dust-proof window 71 is inserted so that it can move in the arrow direction along the guide member 93 with the face, to which the seal material B 71*c* is stuck, on the optical housing 90 side. Similar to the optical housing 90, an aperture portion for transmitting scanning light is provided on the guide member 93. Further, the movable dust-proof window 71 is pressed onto the optical housing 90 by a (not illustrated) urging member provided on the guide member 93.

Figure 11:
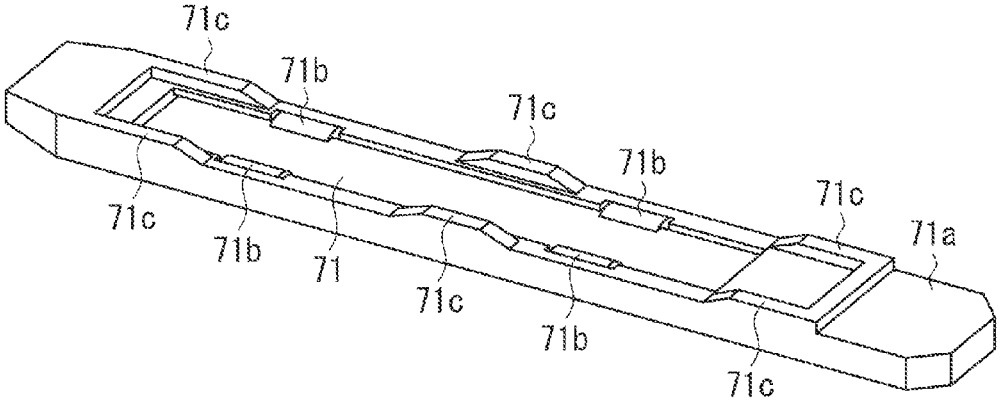
FIG. 11 illustrates a movable dust-proof window and surrounding members according to a fourth exemplary embodiment.

A fourth exemplary embodiment will now be described. FIG. 11 is a schematic perspective view of a holding member. Parts having the same function as in FIG. 4 are denoted with the same reference numerals, and a description thereof will be omitted here. The movable dust-proof window 71 is formed from a parallel plate glass with a thickness of about 2 mm. The movable dust-proof window 71 is mounted on the dust-proof window holding member 71*a*. A part of the glass periphery is fixed by the adhesive 71*b*.

Ribs 71*c* are formed at a plurality of locations on the holding member. These ribs 71*c* are configured so as to come into contact with the casing, while a portion one step down from the ribs 71*c* in FIG. 11 does not come into contact with the casing. When pressed onto the optical housing 90 by a (not illustrated) urging member, the ribs 71*c* are in contact with the casing, and the portion one step down is not in contact with the casing. Consequently, air can more easily circulate between the second and the third spaces. When air can circulate more easily, it is easier for the temperature in the second and the third spaces to become in equilibrium. Further, when there is no temperature difference between the second and the third spaces, air convection is less likely to occur when the movable dust-proof window 71 is removed, which makes it more difficult for dust to adhere to the fixed dust-proof glass surface.

Figure 12:
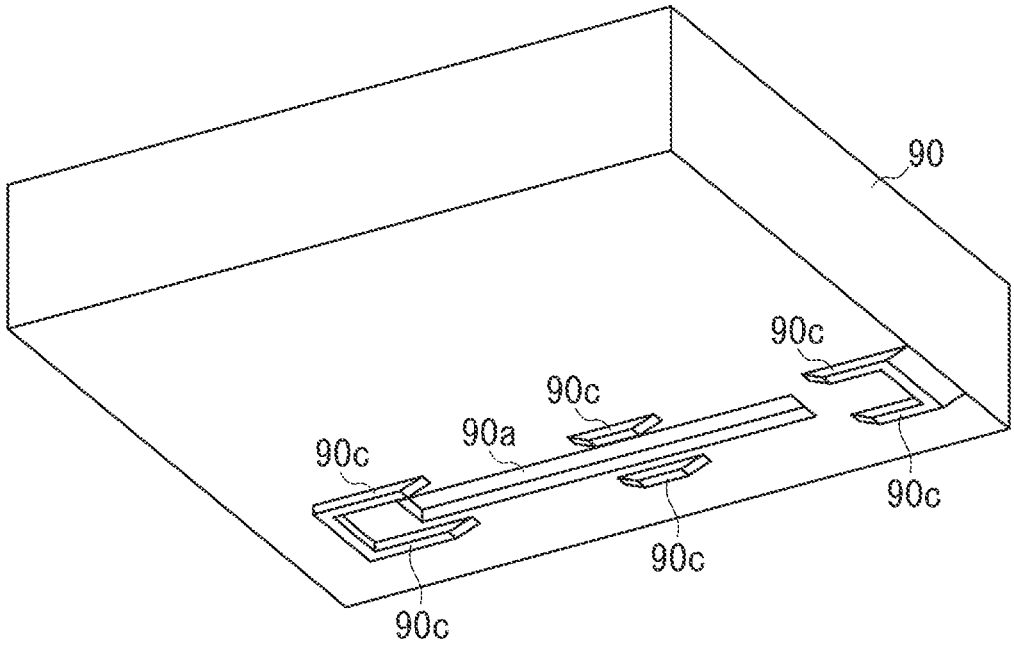
FIG. 12 is a perspective view of the external side of an optical housing of an optical scanning apparatus according to the fourth exemplary embodiment.

FIG. 12 illustrates another method for obtaining the same effect. Ribs 90*c* are formed at a plurality of locations on portions of the optical housing 90 on which the dust-proof window holding member 71*a* abut. On the other hand, ribs 71*c* are not formed on the dust-proof window holding member 71*a*. When the dust-proof window holding member 71*a* is pressed on the optical housing 90 by a (not illustrated) urging member, a gap forms between the portions without ribs and the dust-proof window holding member 71*a*. The configuration described above can also obtain a similar effect.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-225879 filed Oct. 5, 2010, which is hereby incorporated by reference herein in its entirety.

What is claimed is:

1. An optical scanning apparatus comprising:

a light source;

a deflection unit configured to deflect a light beam emitted from the light source so that the light beam scans on a photosensitive member;

a casing to which the light source is attached and in which the deflection unit is housed, the casing being provided with an aperture through which the light beam deflected by the deflection unit passes;

a first light transmission member, fixed to the casing, configured to seal the aperture to be dust-proof for a space inside the casing, and transmit the light beam;

a second light transmission member configured to transmit a light beam that has been transmitted through the first light transmission member, the second light transmission member being detachable from the optical scanning apparatus; and a guide member provided to the casing, configured to guide the second light transmission member in a longitudinal direction of the second light transmission member and hold the second light transmission member, wherein a space sealed from the space inside the casing and a space outside the optical scanning apparatus is formed by the guide member, the second light transmission member held by the guide member, and the first light transmission member so that the first light transmission member is protected from dust.

2. The optical scanning apparatus according to claim 1, wherein the second light transmission member is slid in a longitudinal direction of the second light transmission member so as to be attached to the casing.

3. The optical scanning apparatus according to claim 1, wherein the first light transmission member is a transparent member.

4. The optical scanning apparatus according to claim 1, wherein the second light transmission member is a transparent member, and wherein the guide member is configured to hold the transparent member, the guide member partially protrudes from the casing in a longitudinal direction of the second light transmission member when the second light transmission member is attached to the casing.

5. An image forming apparatus comprising:
a photosensitive member; and
an optical scanning apparatus according to claim 1.

* * * * *